US008142218B2

(12) United States Patent
Rudolph et al.

(10) Patent No.: US 8,142,218 B2
(45) Date of Patent: Mar. 27, 2012

(54) ELECTRICAL PUSH-PULL PLUG CONNECTOR

(75) Inventors: Paul Rudolph, Stuttgart (DE); Gerhard Wehrle, Donaueschingen (DE)

(73) Assignee: Coninvers GmbH, Herrenberg (DE)

( * ) Notice: Subject to any disclaimer, the term of this patent is extended or adjusted under 35 U.S.C. 154(b) by 62 days.

(21) Appl. No.: 12/792,846

(22) Filed: Jun. 3, 2010

(65) Prior Publication Data

US 2010/0330835 A1 Dec. 30, 2010

(30) Foreign Application Priority Data

Jun. 24, 2009 (EP) ..... 09008248

(51) Int. Cl.
*H01R 13/627* (2006.01)

(52) U.S. Cl. ..... 439/357

(58) Field of Classification Search ..... 439/357–358, 439/352–353, 188, 578, 489, 752
See application file for complete search history.

(56) References Cited

U.S. PATENT DOCUMENTS

| | | | | |
|---|---|---|---|---|
| 6,464,526 | B1 | 10/2002 | Seufert et al. | |
| 7,252,556 | B2 * | 8/2007 | Anbo et al. | 439/752 |
| 7,402,069 | B2 * | 7/2008 | Shigeta et al. | 439/352 |
| 7,663,561 | B2 * | 2/2010 | Hisaeda | 343/713 |
| 7,682,189 | B2 * | 3/2010 | Yamaguchi et al. | 439/557 |
| 7,725,994 | B2 * | 6/2010 | Funo et al. | 24/625 |
| 7,753,712 | B2 * | 7/2010 | Miki | 439/353 |
| 7,857,651 | B2 * | 12/2010 | Chen | 439/352 |
| 2002/0025712 | A1 * | 2/2002 | Mochizuki et al. | 439/357 |
| 2003/0017739 | A1 * | 1/2003 | Sawayanagi | 439/357 |
| 2007/0020986 | A1 * | 1/2007 | Fry et al. | 439/357 |
| 2008/0014778 | A1 * | 1/2008 | Norwood et al. | 439/314 |
| 2008/0124966 | A1 * | 5/2008 | Lim | 439/357 |
| 2008/0248680 | A1 * | 10/2008 | Stoner et al. | 439/357 |

FOREIGN PATENT DOCUMENTS

| | | | |
|---|---|---|---|
| DE | 39 28 710 | A1 | 3/1991 |
| DE | 195 21 754 | A1 | 12/1996 |
| EP | 0 082 320 | A | 6/1983 |
| GB | 2 373 380 | A | 9/2002 |
| WO | 99/13536 | A | 3/1999 |

OTHER PUBLICATIONS

European Search Report for corresponding European Application No. EP 09 00 8248 dated Oct. 14, 2009.

* cited by examiner

*Primary Examiner* — Jean F Duverne
(74) *Attorney, Agent, or Firm* — Renner, Otto, Boisselle & Sklar, LLP

(57) ABSTRACT

An electrical plug connector based on the push-pull system, with a plug component and a matching plug component that can be connected to the plug component, both of which each include one or several associated electrical contacts held by a contact carrier, and with a locking mechanism that is provided on the plug component and includes at least one movable locking element with a latch surface that is associated, on the matching plug component, with a fixed locking element with a matching surface for the latch surface. The plug component includes a plug component housing with an axially displaceable sliding sleeve with an actuation element for the locking element formed on the inside wall, wherein, when the plug component is connected to the matching plug component, a—in the plug-in direction—frontal section of the circumferential wall area of the plug component housing overlaps the matching plug component on the outside in a plug-in area. The locking element projects radially beyond an inner surface of the circumferential wall area, and the locking of the locking element with the matching locking element is achieved by moving the locking element transversely to the plug-in direction of the plug connector along the circumferential wall area.

15 Claims, 5 Drawing Sheets

ELECTRICAL PUSH-PULL PLUG CONNECTOR

CROSS-REFERENCE TO RELATED APPLICATION

The present application claims priority under 35 USC §119 to European Patent Application No. 09 008 248.8 filed Jun. 24, 2009, the entire disclosure of which is incorporated herein by reference.

TECHNICAL FIELD OF THE INVENTION

The invention concerns an electrical plug connector based on the push-pull system, with a plug component and a matching plug component that can be connected to the plug component, both of which each comprise one or several associated electrical contacts held by a contact carrier, and with a locking mechanism that is provided on the plug component and comprises at least one movable locking element with a latch surface that is associated, on the matching plug component, with a fixed locking element with a matching surface for the latch surface, with the plug component comprising a plug component housing with an axially displaceable sliding sleeve with an actuation element for the locking element formed on the inside wall, where, when the plug component is connected to the matching plug component, a—in the plug-in direction—frontal section of the circumferential wall area of the plug component housing overlaps the matching plug component on the outside. The circumferential wall section and/or the plug component housing may have a cross-section of any shape, i.e. they may be angular, round, or oval.

DESCRIPTION OF THE RELATED ART

Electrical plug connectors are available with and without locking of the plugged-in plug connector components. For locking the plug connector components, a wide variety of locking systems are known, for example in the form of a box nut that is rotatably held on the plug component and can be screwed onto an external thread of the matching plug component, or in form of a latching device provided on the plug component that latches non-permanently onto the matching plug component and can be disengaged from associated holding elements of the matching plug component by actuating a disengagement element. A known locking system with a latch mechanism is the so-called push-pull locking system.

Generally, a push-pull locking system is understood to be a locking system of an electrical plug connector wherein the plug component is connected to the matching plug component in a mechanically secure connection when the electrical contacts are being plugged together by pushing the plug component into the matching plug component. After the plug component has been completely inserted into the matching plug component, it is automatically locked with the matching plug component. This requires no additional motions, specifically no additional manipulation for locking the electrical plug connector.

Normally, with commonly used plug connectors based on the push-pull system, the plug component with contact sockets is equipped with an unlockable locking mechanism that, when pushed into the matching plug component, engages an undercut provided on the matching plug component with the contact pins. To unlock it, the sliding sleeve on the plug component is pulled back in the direction of the cable, which causes the locking mechanism of the plug component to disengage from the undercut of the matching plug component so that the plug component can be pulled out of the matching plug component. A large number of push-pull locking systems are known; for examples, the publications DE 39 28 710 A1 and DE 195 21 754 A1 may be referred to.

DE 39 28 710 A1 discloses an electrical plug connection consisting of two connecting elements forming a plug and a socket component, with one connecting element comprising at least one locking element that is held in a positive guide of a housing and can be radially displaced by means of an axial slide; in the locked position, said locking element engages a shoulder of the other connecting element, and can be placed in an unlocking position that disengages the shoulder by the manual displacement of the axial slide that is acted upon by a spring arrangement. For simplicity of design, the spring arrangement is formed by at least one stamped metal part that surrounds the housing, is sectionally supported, and has unsupported areas that are acted upon by the axial slide.

The publication DE 195 21 754 A1 specifies a plug connector based on the push-pull system with a plug component that comprises a number of electrical contact pins and/or contact sockets that are connected to the conductors of a cable, and a device component that accepts the plug component and that comprises a corresponding number of matching contacts that can be connected to the contact pins or contact sockets of the plug component. In addition, the plug connector comprises a locking mechanism that, on the plug side, comprises locking claws each of which has a latch surface and protrudes axially on the front side of a locking sleeve, and which are associated, on the device component, with an element with matching surfaces which, in locked condition, are engaged by the latch surfaces of the locking claws and are released when the locking sleeve is acted upon axially, sliding along the matching surfaces. The locking claws are associated with an elastomeric element that counteracts the swiveling of the locking claws for an unlocking process.

While plug connectors based on the push-pull system are simple to operate, they find little use in the market because, on the one hand, they are more complex and therefore more expensive when compared with plug connectors with a bayonet or screw lock, and because, on the other hand, they have a lower vibration strength.

SUMMARY OF THE INVENTION

Therefore, the invention intends to solve these problems by proposing an improved plug connector of this type wherein the plug component is easy to plug into and pull out of the matching plug component and, when fully inserted in the matching plug component, is held securely in the matching plug component even under high vibration loads. In addition, the locking mechanism of the proposed electrical push-pull plug connector is relatively uncomplicated and consists of few parts that are simple to manufacture, easy to assemble, and inexpensive.

According to the invention, this problem is solved by an electrical plug connector with the characteristics of patent claim 1. Additional advantageous embodiments are given in the related patent claims.

In the electrical plug connector with push-pull locking mechanism according to the invention, a locking element of a plug component protrudes radially beyond an inner surface of a frontal circumferential edge of a plug component housing. When connected to the matching plug component, the plug component engages with this locking element the matching plug component on the outside at an associated end. The plug component as well as the matching plug component that can be non-permanently connected to the plug component each have one or several associated electrical contacts held by an insulating contact carrier, with a locking mechanism of the push-pull system provided on the plug component and comprising at least one movable locking element with the characteristics specified above. In addition, the locking element comprises a latch surface that is associated, on the matching plug component, with a fixed matching locking element with a matching surface for the latch surface. According to the invention, the locking of the locking element of the plug component with the matching locking element of the matching plug component is accomplished by moving the locking element transversely to the plug-in direction of the plug connector along the circumferential wall area. The plug component carries a sliding sleeve that is axially displaceable in the plug-in direction relative to the plug component housing, with an actuation element for the locking element of the plug component that is arranged at an inner circumference of the sliding sleeve.

It proved to be advantageous to equip the sliding sleeve that is guided axially displaceably in and against the plug-in direction of the plug component on the frontal circumferential wall area of the plug component housing with a stop for the plug component housing on a frontal face side in the plug-in direction, and to form, as second stop on a rear face side opposite the frontal face side, holding devices that act together with associated fixing devices of the plug component housing in such a way that the sliding sleeve can be displaced in the axial direction from a start position in which it does not engage the locking element with the actuation element to a working position in which the actuation element moves the locking element from a locking position to a release position, and vice versa. In addition, it is expedient to adapt the interior diameter of the sliding sleeve to the exterior diameter of the circumferential wall area of the plug component in such a way that the sliding sleeve can be moved freely axially and without tilting on the plug component.

Preferably, the locking element of the plug component and the matching locking element of the matching plug component each comprise at least one associated latch surface or matching surface that slide along each other during the locking and unlocking process of the plug connector, with the latch surface extending essentially parallel to a face side of the circumferential wall area of the plug component, and with the matching surface extending correspondingly to the face side of the circumferential wall area when the plug component is connected to the matching plug component. With the plug connector locked, the latch surface and its matching surface always extend parallel to each other. The latch surface and the matching surface may also be slightly inclined relative to the face side of the circumferential wall area, as is known from the pitch of threads. This permits a tolerance compensation in the axial direction for the plug connector. As long as the latch surface and the matching surface face each other, the plug component is locked to the matching plug component and cannot be disengaged from the matching plug component by itself. It is only when the latch surface and the associated matching surface are completely staggered laterally in the extension direction, that the plug component and the matching plug component are unlocked from each other so that the plug component of the plug connector can be removed from the matching plug component. In order to ease the plugging of the plug component into the matching plug component it may also be helpful if a spring exerts a small force on the sliding sleeve in or against the plug-in direction of the plug component, with the spring holding the sliding sleeve in a defined position also in locked condition when the device vibrates, thereby counteracting any unintentional unlocking of the plug component from the matching plug component. For this, a spring whose spring force is approximately equivalent to the weight force of the sliding sleeve is usually sufficient. Ideally, the spring—for example a coil spring—pushes the sliding sleeve with a small force against the plug-in direction in the direction of the plug component housing.

In an advantageous embodiment of the invention, the latch surface of the locking element is flat and slightly inclined relative to the face side of the circumferential wall area of the plug component, with the matching surface of the matching locking element having a sharp or rounded matching edge for the latch surface, along which the latch surface is able to slide during the locking or unlocking process of the plug connector. This permits a certain tolerance compensation in the axial direction and ensures that it is able to engage the matching locking element without problems and in a secure manner when the plug component and the matching plug component are connected. In this context, 'slightly inclined' means an inclination of a few degrees of angle relative to the face side of the circumferential wall area of the plug component.

In a preferred embodiment of the plug connector according to the invention, the matching locking element is undercut in the axial direction of the matching plug component, with the locking element engaging said undercut when the plug connector is locked in a locking position. For the purpose of performing the motion transversely to the plug-in direction of the plug connector along the circumferential wall area, the locking element is advantageously guided—displaceably parallel to the circumferential wall area—on the circumferential wall area, and is preferably acted upon in the locking direction by a spring element. The guide permits the locking element to slide freely, without binding in any position. The spring element may be made of plastic or metal, and may consist of a tension or a compression spring. Due to the force of the spring element acting in the locking direction, the locking element is moved reliably into the locking position in which the locking element engages the undercut of the matching locking element, and is held there.

In one embodiment of the invention, the locking element and the matching locking element preferably comprise associated connection slide surfaces that move the locking element against the locking direction when the plug component is plugged into the matching plug component. The connection slide surface of the locking element extends at an acute angle in relation to the latch surface of the locking element, and the connection slide surface of the matching locking element may have any shape and direction on the matching plug component as long as it moves the locking element against the locking direction into the release position as the plug component is plugged into the matching plug component.

In an advantageous embodiment of the electrical plug connector according to the invention, the locking element of the plug component and the actuation element of the sliding sleeve have associated unlocking slide surfaces which are inclined towards the plug-in direction of the plug component relative to the face side of the plug component and which move the locking element against the locking direction into the release position when the sliding sleeve of the plug component is displaced axially against the plug-in direction of the plug component. Depending on the angle of inclination of the unlocking slide surfaces, the tensile force on the sliding sleeve is divided into force components perpendicular and parallel in the opposite direction to the spring force direction of the spring element so that the plug connector can be disengaged simply and without too much force from the matching plug component. Depending on the requirements, the disengagement force can be selected by varying the angle of inclination.

In a preferred embodiment of the invention, the locking element comprises two locking jaws on which the spring element supports itself with its ends.

Advantageously, the two locking jaws are of homologous design and are arranged on the plug component following one another in a homologous configuration. Preferably, the connection and the unlocking slide surfaces of the locking jaw are of identical shape and extend, in essential sections, parallel to each other, with the connection slide surface protruding radially beyond the interior surface of the circumferential wall area, and the unlocking slide surface being located at a distance from the connection slide surface in the radial direction of the plug component. The connection slide surface and the unlocking slide surface may face each other or be staggered from each other transversely to the plug-in direction. The latch surfaces of the two locking jaws that each form an acute angle with the connection slide surface and the unlocking slide surface of the same jaw are aligned with each other while the connection slide surfaces and the unlocking slide surfaces of the two locking jaws are inclined in the opposite direction relative to the plug-in connection.

Corresponding to the circumferential wall area on which they are arranged, the locking jaws may be designed straight or curved, and can accordingly be held in contact without problems between the circumferential wall area of the plug component housing and the sliding sleeve, and be guided laterally displaceably by the same. The spring element of the locking element acts upon the two locking jaws in the opposite direction, and forces them into the locking position transversely to the plug-in direction of the plug component. In principle, instead of the single spring element, it is possible to use two independent spring elements that may also be molded onto the locking jaws.

In order to avoid changing the diameter of the plug connector with the locking mechanism in comparison with the diameter of a conventional plug connector, the circumferential wall area of the plug component preferably has a U-shaped recess that accepts the locking element or the two locking jaws forming the locking element. Advantageously, the recess has a guide rib for guiding the locking element or the locking jaw in question, with an associated guide groove provided in the locking element or the locking jaw in question. For example, the guide groove may extend between the connection slide surface and the unlocking slide surface of the locking element, especially if these are parallel to and aligned with each other.

In a preferred embodiment, the actuation element of the sliding sleeve projects radially from an interior wall of the sliding sleeve. It can therefore engage the U-shaped recess of the circumferential wall area and act on the locking element or the locking jaws. It is self-evident that an associated actuation element is provided on the sliding sleeve for each locking element or for each locking jaw.

In a preferred embodiment of the plug connector according to the invention, the plug component has at least two locking elements arranged symmetrically on the circumferential wall. In the case of two locking elements that may each comprise one or two locking jaws, they are ideally arranged diametrically opposed on the circumferential wall area; in the case of more than two locking elements, these are preferably distributed evenly along the circumferential wall area. On the one hand, this strengthens the locking of the plug component and the matching plug component, and, on the other hand, it reduces the axial play in the alignment of the plug component in relation to the matching plug component which relieves the stress on the electrical contacts.

To summarize briefly, the plug connector according to the invention with the locking system as proposed offers a multitude of advantages over conventional push-pull plug connectors. This new type of locking system completely eliminates the usual tolerances of plug component and matching plug component so that, when the plug connector is locked, there is no play as in the push-pull systems known until now. The plug component is always pulled into the matching plug component up to the stop. In addition, the locking force always stays the same. As a result, the new plug connector meets the highest demands regarding the pull-out force, and is therefore extremely vibration resistant. Furthermore, its manufacturing costs are significantly lower than those of known push-pull plug connectors.

Below, the invention is explained in detail with reference to an embodiment shown in the drawing. Additional characteristics of the invention are given in the following description of the embodiment of the invention in conjunction with the claims and the attached drawing. The individual characteristics of the invention may be realized either individually by themselves or in combinations of several in different embodiments of the invention.

DETAILED DESCRIPTION OF THE INVENTION

Figure 1:
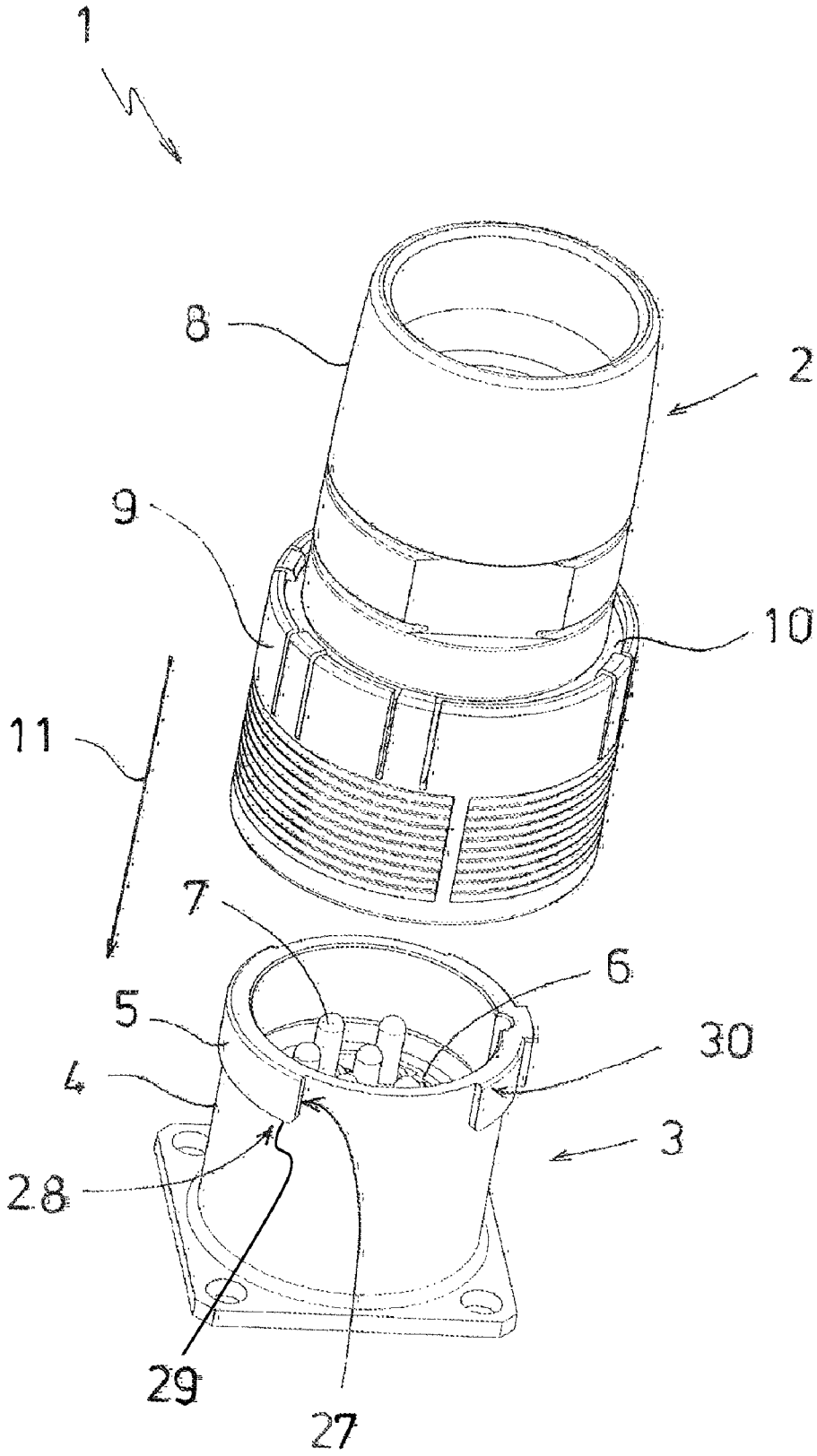
FIG. 1 shows an electrical plug connector according to the invention with a plug component and a matching plug component in separated condition.
Figure 4:
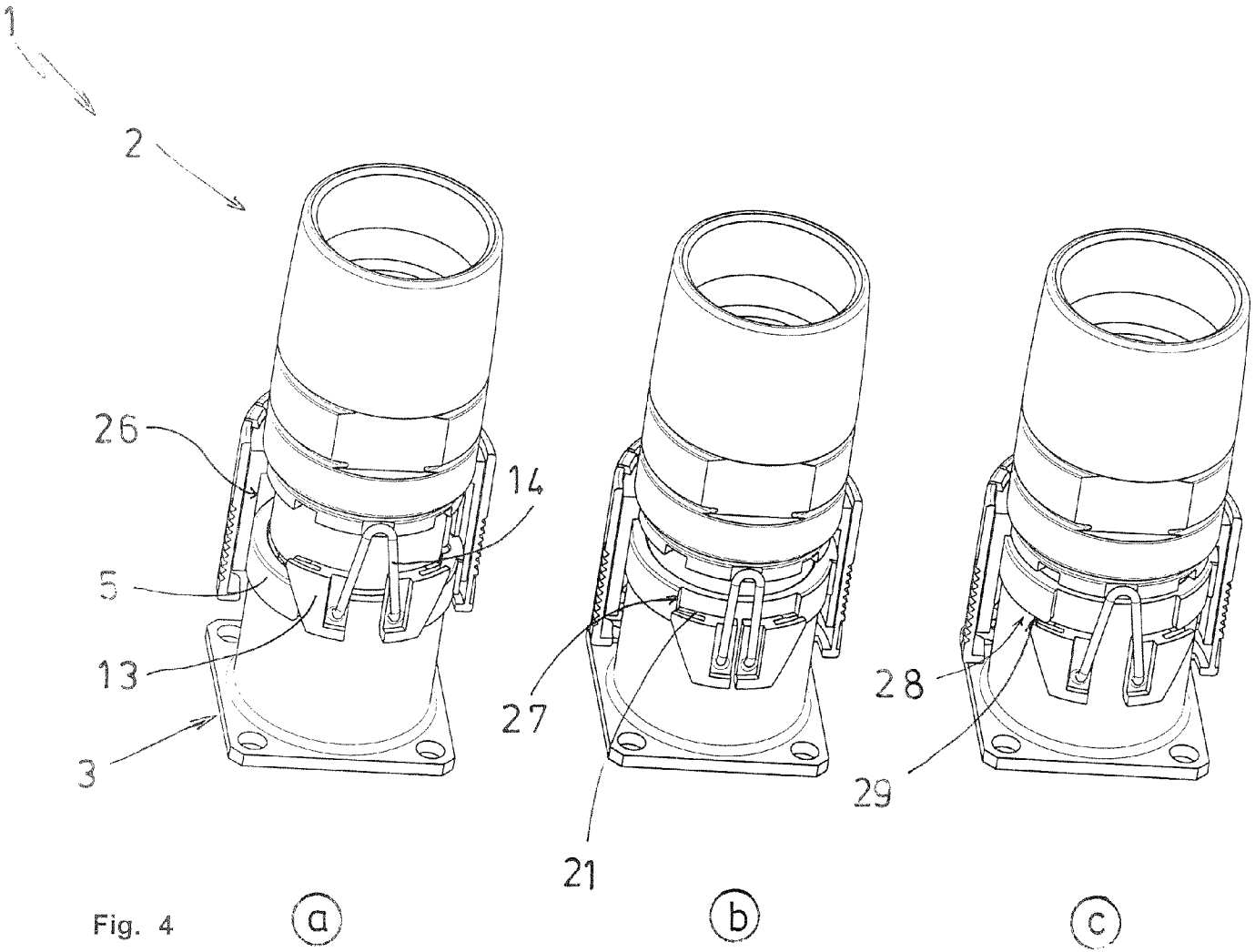
FIG. 4 shows the plug component from FIG. 1 in various plugged-in positions relative to the matching plug component, with the plug component ready to enter (FIG. 4*a*), the plug component partially inserted (FIG. 4*b*), the plug component completely inserted and locked (FIG. 4*c*)

FIG. 1 shows a perspective view of an electrical plug connector 1 according to the invention designed as a round plug connector. The plug connector 1 comprises a plug component 2 arranged at the end of a cable (not shown) and a matching plug component 3 that is intended to be attached to a device housing (also not shown). The matching plug component 3 comprises a cylindrical plug-in area 4 with a segmented collar 5 that encloses a contact carrier 6 with electrical contacts 7. The plug component 2 has an essentially cylindrical plug component housing 8 that carries a tubular sliding sleeve 9 on the plug-in side facing the matching plug component 3. The sliding sleeve 9 overlaps a—in the plug-in direction—frontal circumferential wall area 10 of the plug component housing 8 which, in turn, overlaps on the outside the plug-in area 4 with the collar 5 when the plug component 2 is connected to the matching plug component 3, as shown in FIG. 4. As in the plug-in area 4 of the matching plug component 3, a contact carrier (not shown in FIG. 1) with electrical contacts is arranged in the plug component housing 8, said contacts being designed to correspond to the contacts 7 of the matching plug component 3.

The plug connector 1 comprises, in a concealed arrangement, a locking mechanism for the automatic locking of the plug component 2 with the matching plug component 3 as soon as the former is completely inserted into the matching plug component 3. The sliding sleeve 9 serves to unlock the plug component 2 of the plug connector 1 from the matching plug component 3 and acts on the locking mechanism. The unlocking proceeds in the manner common for push-pull systems, in that the sliding sleeve 8 is moved axially against the plug-in direction 11 of the plug component 2. For this purpose, the sliding sleeve 9 is guided displaceably in the axial direction on the circumferential wall area 10 of the plug component 2.

Figure 2:
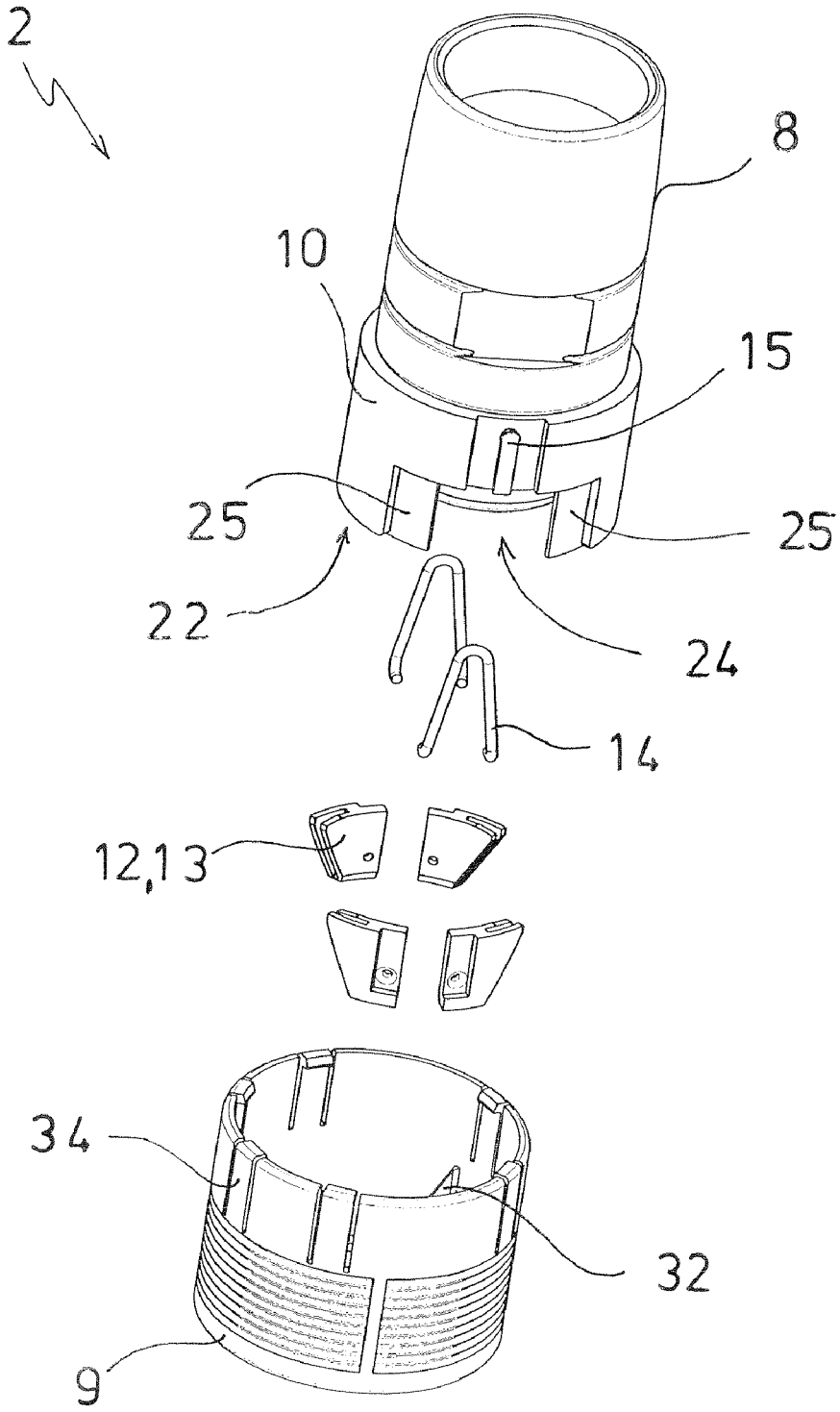
FIG. 2 shows the plug component from FIG. 1 in an exploded view.

FIG. 2 shows an exploded view of the plug component 2. In this view, the plug component 8 is no longer partially covered, and the locking mechanism no longer covered completely by the sliding sleeve 9. Now, on the plug-in side of the plug connector 8, the circumferential wall area 10 is visible with which the plug component 2 in plugged-in condition overlaps the plug-in area 4 of the matching plug component 3. It is now also possible to see the locking mechanism which, in the embodiment shown here, comprises locking elements 12 in the form of 4 locking jaws 13 as well as two V-shaped spring elements 14. As FIG. 4 shows, two locking jaws 13 are each connected by direct contact to a spring element 14 transversely to the plug-in direction 19, with the spring element 14 acting upon the locking jaws 13 transversely to the plug-in direction 11 of the plug component 2, pushing them apart. The spring element 14 is fixed on the circumferential wall area 10 by means of a support rib 15 in and transversely to the plug-in direction 11, and supports itself towards the outside in the radial direction of the plug component housing 8 on the sliding sleeve 9.

Figure 3:
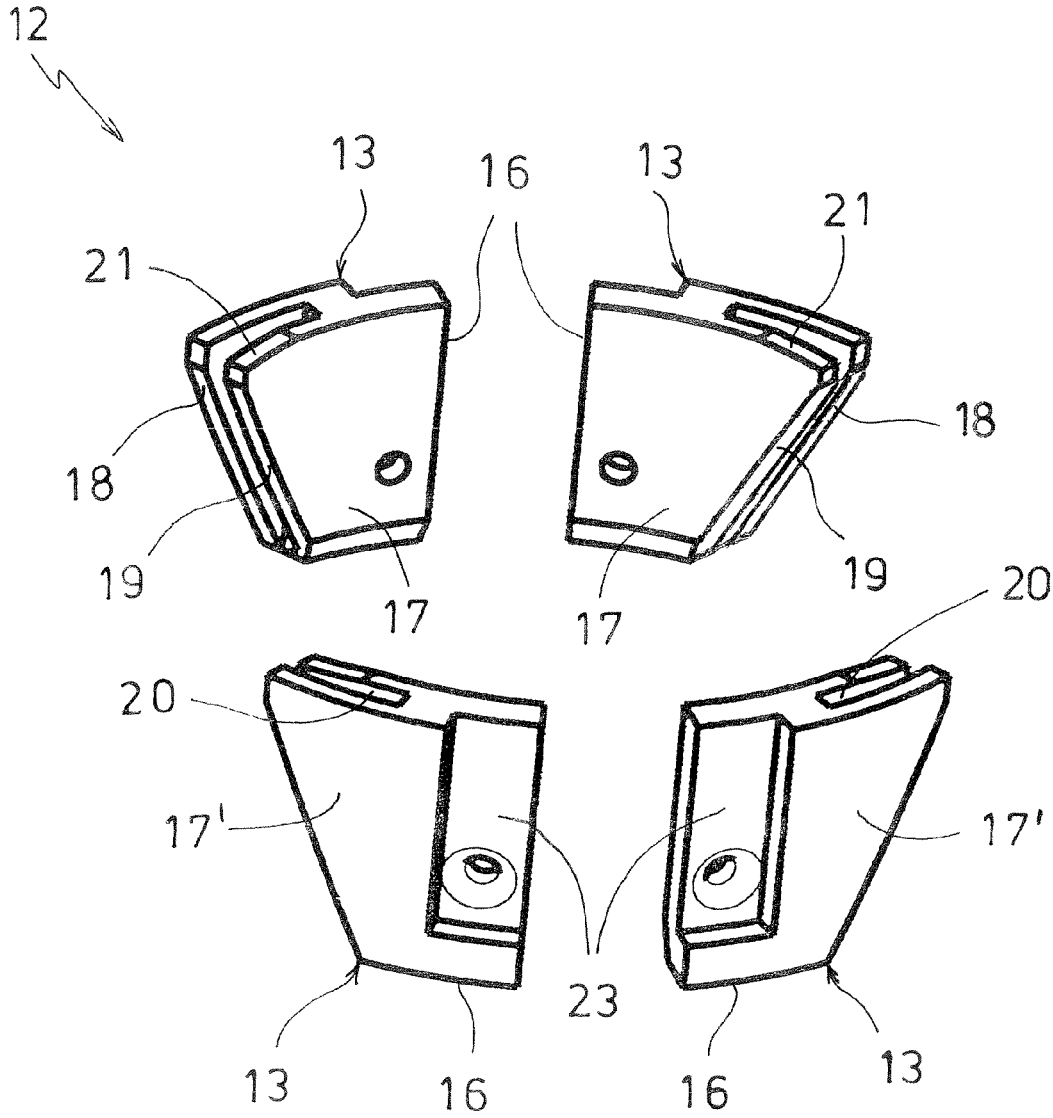
FIG. 3 shows the locking jaws of the locking element from FIG. 2 in an enlarged view.

FIG. 3 shows an enlarged view of the locking jaw 13 with a view of the two broadsides 17, 17'. The locking jaw 13 is flat and its curvature matches the shape of the circumferential wall area 10 of the plug component housing 2. In a top view of the broadsides 17, 17' it has a trapezoid outer contour, with the outer broadside 17' being associated with the sliding sleeve 9 and the inner broadside 17 being associated with the plug-in area 4 of the matching plug component 3. On the outer broadside 17', the locking jaw 13 has an unlocking slide surface 18 and on the inner broadside 17 an unlocking slide surface 19 that extend parallel to and laterally at a distance from each other, separated from each other by a guide groove 20. With the locking element 12 or the locking jaw 13 in assembled condition, the unlocking and the connection slide surfaces 18, 19 are aligned at an acute angle of approximately 25° relative to the plug-in direction of the plug component 2, as can be seen in FIG. 4. Also at an acute angle of approximately 65°, a latch surface 21 of the locking jaw 13 extends transversely to the connection slide surface 19 and is slightly inclined relative to a face side 22 of the circumferential wall area 10. Also, the locking jaw 13 has recesses 23 for accepting the spring elements 14 on the outer broadside 17'. In order to lock together the plug component 2 and the matching plug component 3, two locking jaws 13 each of homologous shape are provided in a homologous arrangement.

In order to accept the four locking jaws 13, the circumferential wall area 10 of the plug connector 1 has two diametrically opposed recesses 24 that are equipped with a guide rib 25 that engages the guide groove 20 of the locking jaw 13. The guide rib 25 guides the locking jaw 13 in question displaceably on the circumferential wall area 10, transversely to the plug-in direction 11 of the plug connector 2. The locking jaws 13 have a thickness that is greater than the wall thickness of the circumferential wall area 10. The outer broadside 17' of the locking jaws 13 is in alignment with the circumferential wall area 10 on the outside so that the inner broadside 17 of the locking jaw 13 projects radially beyond an inner surface 26 of the circumferential wall area 10. The connection slide surface 19 thereby protrudes radially from the inner surface 26 and, when the plug component 2 is inserted into the matching plug component 3, is able to interact with an associated connection slide surface 27 of the collar 5 of the plug-in area 4 of the matching plug component 3 in such a way that the locking element 12 or the locking jaws 13 of the electrical plug connector 1 are moved against the locking direction.

The plug-in process of the plug component 2 into the matching plug component 3 is shown in detail in three different positions in FIG. 4. FIG. 4*a* shows the plug component 2 placed onto the matching plug component 3; FIG. 4*b* shows it partially inserted into the matching plug component 3; and FIG. 4*c* shows it completely inserted into and locked with the matching plug component 3. The sliding sleeve 9 is shown in a sectional view in order to offer a view of the locking mechanism. When the plug component 2 is placed onto the matching plug component 3, the connection slide surface 19 of the locking jaw 13 comes into contact with the connection slide surface 27 of the plug-in area 4 of the matching plug component 3. The connection slide surface 27 extends parallel to the plug-in direction 11 on the matching plug component 3 and forms a transverse surface (shown in FIG. 1) of the segmented collar 5 of the plug-in area 4.

A comparison of the views in FIGS. 4*a*, 4*b* shows that the locking jaws 23 move towards each other with increasing insertion depth of the plug component 1 in relation to the matching plug component 3, with the spring element 14 being tensioned. The connection slide surface 27 of the collar 5 of the plug-in area 4 extends up to an undercut 28 of the matching plug component 3 that is determined by the collar 5. As soon as the plug component 1 is completely inserted into the matching plug component 3, the locking jaws 23 are no longer in contact with the connection slide surface 27 of the plug-in area 4 so that the V-shaped spring element 14 spreads open transversely to the plug-in direction 11 of the plug component 1 and moves the locking jaws 23 transversely to the plug-in direction 11 into the locking position. At the same time, the latch surface 21 of the locking jaw 13 slides along a matching surface 29 of the undercut 28 of the collar 5 that forms the fixed matched locking element 30 for the locking element 12.

When the locking element 12 is being locked with the matched locking element 30, the locking element 12 or the locking jaw 13 moves transversely to the plug-in direction 11 of the plug connector 1 along the circumferential wall area 10. The latch surface 10 or the matching surface 29 of the plug connector 1 slide along each other during the locking and the unlocking of the plug connector 1, with the matching surface 29 extending parallel to the face side of the circumferential wall area 10 when the plug component 1 is connected to the matching plug component 3, and with the latch surface 21 of the locking element 12 being slightly inclined relative to the face side 22 of the circumferential wall area 10.

Figure 5:
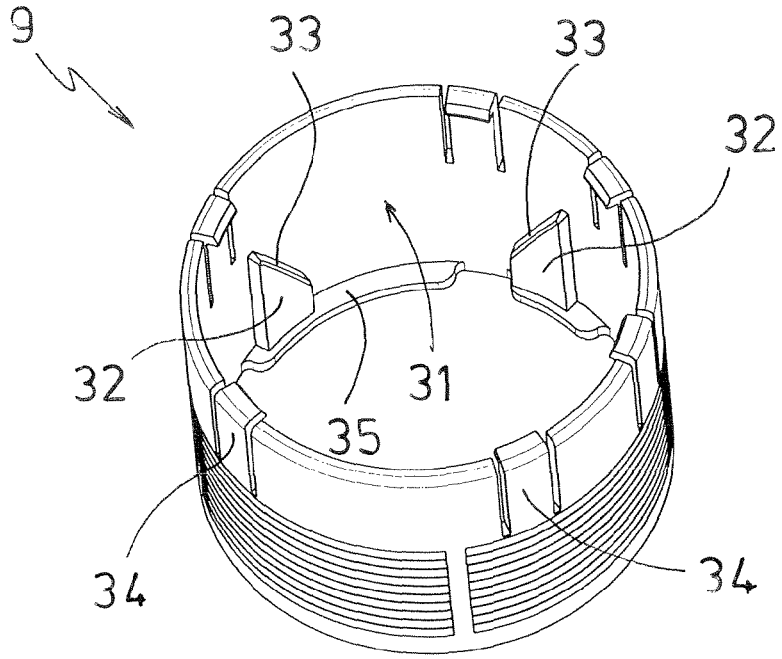
FIG. 5 shows the sliding sleeve from FIG. 1 in a view at the interior wall.

FIG. 5 shows the sliding sleeve 9 with a view of an inner wall 31. On the inner wall 31, actuation elements 32 for unlocking the plug component 1 from the matching plug component 3 are provided that act upon the locking jaws 13 when the sliding sleeve 9 is displaced axially against the plug-in direction 11 of the plug component 1 into the matching plug component 3, and move the locking jaws 13 away from the undercut 28 of the collar 5 of the plug-in area 4 with tension of the spring element 14. The actuation element 13 has an unlocking slide surface 33 that is associated with the unlocking slide surface 18 of the locking jaw 13 and has an inclination that corresponds to the unlocking slide surface 18. The unlocking slide surfaces 18, 33 slide on each other when the plug component 2 is unlocked from the matching plug component 3. The actuation element 32 of the sliding sleeve 9 projects radially from the inner wall 31 of the sliding sleeve 9 and engages the recess 24 of the circumferential wall area 10 of the plug component housing 8 when the sliding sleeve 9 is displaced axially against the plug-in direction 11 of the plug component 1.

Figure 6:
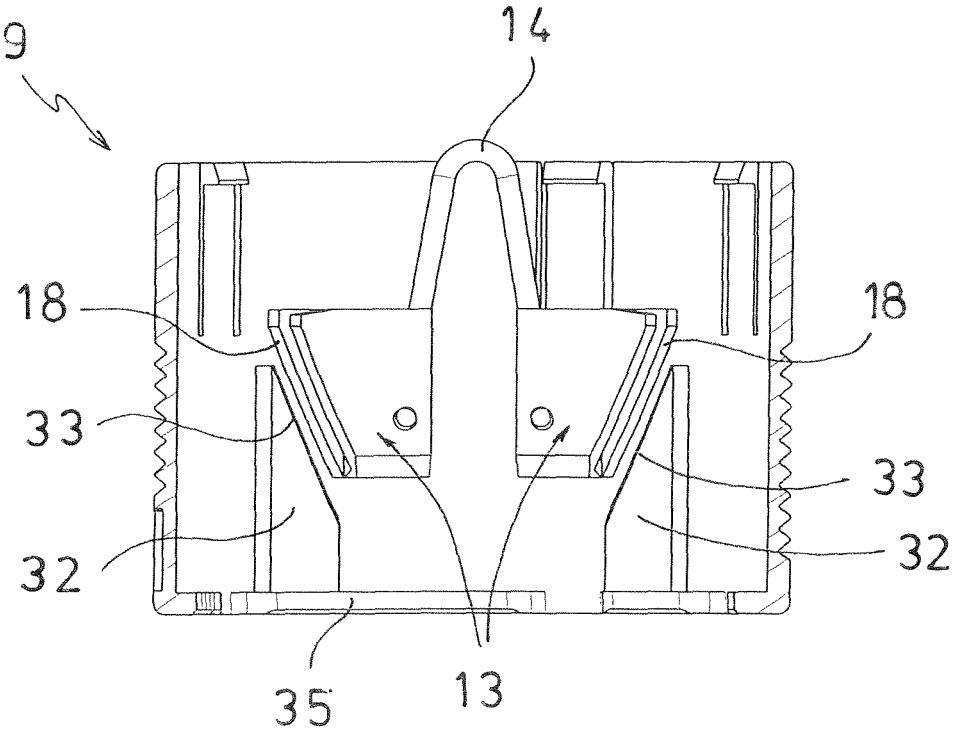
FIG. 6 shows the sliding sleeve from FIG. 5 in combination with the locking element from FIG. 2.

FIG. 6 shows a sectional view of the design of the actuation element 32 in an enlarged view, as well as the arrangement of the locking jaws 13 in relation to the actuation element 32. It can be seen clearly that the associated unlocking slide surfaces 18 are flat and parallel to each other. FIG. 6 also shows latch elements 34 with which the sliding sleeve 9 is mounted displaceably in the axial direction on the plug component housing 8, and an axial stop 35 for the circumferential wall area 10.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electrical plug connector based on the push-pull system, with a plug component and a matching plug component that can be connected to the plug component, both of which each comprise one or several associated electrical contacts held by a contact carrier, and with a locking mechanism that is provided on the plug component and comprises at least one movable locking element with a latch surface that is associated, on the matching plug component, with a fixed locking element with a matching surface for the latch surface, with the plug component comprising a plug component housing with an axially displaceable sliding sleeve with at least one actuation element for the locking element formed on the inside wall, and wherein, when the plug component is connected to the matching plug component, a—in the plug-in direction—frontal section of the circumferential wall area of the plug component housing overlaps the matching plug component on the outside, wherein the locking element projects radially towards the inside beyond an inner surface of the circumferential wall area, the locking of the locking element with the matching locking element is achieved by moving the locking element transversely to the plug-in direction of the plug connector along the circumferential wall area, and the unlocking of the moveable locking element from the fixed locking element is accomplished by moving the locking element via the actuation element of the sliding sleeve transversely to the plug-in direction of the plug connector along the circumferential wall area, where the locking element moves when unlocking in opposite direction as while locking.

2. A plug connector according to claim 1, wherein the locking element of the plug component and the matching locking element of the matching plug component each comprise at least one associated latch surface or matching surface that slide along each other during the locking and unlocking process of the plug connector, with the latch surface extending essentially parallel to a face side of the circumferential wall area of the plug component, and with the matching surface extending correspondingly to the face side of the circumferential wall area when the plug component is connected to the matching plug component.

3. A plug connector according to claim 1, wherein the latch surface of the locking element is flat and slightly inclined relative to the face side of the circumferential wall area of the plug component, with the matching surface of the matching locking element having a sharp or rounded matching edge for the latch surface along which the latch surface is able to slide during the locking or unlocking process of the plug connector.

4. A plug connector according to claim 1, wherein the matching locking element has an undercut in the axial direction of the matching plug component, with the locking element engaging said undercut when the plug connector is locked in a locking position.

5. A plug connector according to claim 1, wherein the locking element is guided—displaceably parallel to the circumferential wall area—on the circumferential wall area, and is acted upon in the locking direction by a spring element.

6. A plug connector according to claim 1, wherein the locking element and the matching locking element comprise associated connection slide surfaces that move the locking element against the locking direction when the plug component is plugged into the matching plug component.

7. A plug connector according to claim 1, wherein the locking element of the plug component and the actuation element of the sliding sleeve have associated unlocking slide surfaces that are inclined towards the plug-in direction of the plug component relative to the face side of the plug component and which move the locking element against the locking direction into the release position when the sliding sleeve of the plug component is displaced axially against the plug-in direction of the plug component.

8. A plug connector according to claim 1, wherein the locking element comprises two locking jaws, and that the spring element supports itself with its ends on the locking jaws.

9. A plug connector according to claim 8, wherein the two locking jaws are of homologous design and are arranged in a homologous arrangement.

10. A plug connector according to claim 1, wherein the circumferential wall area has a U-shaped recess with a guide rib for accepting the locking element, with a guide groove of the locking element being associated with said guide rib.

11. A plug connector according to claim 1, wherein the actuation element of the sliding sleeve projects radially from an inner wall of the sliding sleeve.

12. A plug connector according to claim 1, wherein the plug component comprises at least two locking elements that are arranged symmetrically on the circumferential wall area.

13. An electrical plug connector based on the push-pull system, with a plug component and a matching plug component that can be connected to the plug component, both of which each comprise one or several associated electrical contacts held by a contact carrier, and with a locking mechanism that is provided on the plug component and comprises at least one movable locking element with a latch surface that is associated, on the matching plug component, with a fixed locking element with a matching surface for the latch surface, with the plug component comprising a plug component housing with an axially displaceable sliding sleeve with at least one actuation element for the locking element formed on the inside wall, wherein the latch surface of the locking element is flat and slightly inclined relative to the face side of the circumferential wall area of the plug component, with the matching surface of the matching locking element having a sharp or rounded matching edge for the latch surface along which the latch surface is able to slide during the locking or unlocking process of the plug connector, and wherein, when the plug component is connected to the matching plug component, a—in the plug-in direction—frontal section of the circumferential wall area of the plug component housing overlaps the matching plug component on the outside, wherein the locking element projects radially towards the inside beyond an inner surface of the circumferential wall area, the locking of the locking element with the matching locking element is achieved by moving the locking element transversely to the plug-in direction of the plug connector along the circumferential wall area, and the unlocking of the moveable locking element from the fixed locking element is accomplished by moving the locking element via the actuation element of the sliding sleeve transversely to the plug-in direction of the plug connector along the circumferential wall area, where the locking element moves when unlocking in opposite direction as while locking, and wherein the locking element of the plug component and the actuation element of the sliding sleeve have associated unlocking slide surfaces that are inclined towards the plug-in direction of the plug component relative to the face side of the plug component and which move the locking element against the locking direction into the release position when the sliding sleeve of the plug component is displaced axially against the plug-in direction of the plug component.

14. An electrical plug connector based on the push-pull system, with a plug component and a matching plug component that can be connected to the plug component, both of which each comprise one or several associated electrical contacts held by a contact carrier, and with a locking mechanism that is provided on the plug component and comprises at least one movable locking element with a latch surface that is associated, on the matching plug component, with a fixed locking element with a matching surface for the latch surface, with the plug component comprising a plug component housing with an axially displaceable sliding sleeve with at least one actuation element for the locking element formed on the inside wall, wherein, when the plug component is connected to the matching plug component, a—in the plug-in direction—frontal section of the circumferential wall area of the plug component housing overlaps the matching plug component on the outside, wherein the locking element projects radially towards the inside beyond an inner surface of the circumferential wall area, the locking of the locking element with the matching locking element is achieved by moving the locking element transversely to the plug-in direction of the plug connector along the circumferential wall area, and the unlocking of the moveable locking element from the fixed locking element is accomplished by moving the locking element via the actuation element of the sliding sleeve transversely to the plug-in direction of the plug connector along the circumferential wall area, where the locking element moves when unlocking in opposite direction as while locking, and wherein the locking element is guided—displaceably parallel to the circumferential wall area—on the circumferential wall area, and is acted upon in the locking direction by a spring element, and wherein the locking element of the plug component and the actuation element of the sliding sleeve have associated unlocking slide surfaces that are inclined towards the plug-in direction of the plug component relative to the face side of the plug component and which move the locking element against the locking direction into the release position when the sliding sleeve of the plug component is displaced axially against the plug-in direction of the plug component.

15. An electrical plug connector based on the push-pull system, with a plug component and a matching plug component that can be connected to the plug component, both of which each comprise one or several associated electrical contacts held by a contact carrier, and with a locking mechanism that is provided on the plug component and comprises at least one movable locking element with a latch surface that is associated, on the matching plug component, with a fixed locking element with a matching surface for the latch surface, with the plug component comprising a plug component housing with an axially displaceable sliding sleeve with at least one actuation element for the locking element formed on the inside wall, and wherein, when the plug component is connected to the matching plug component, a—in the plug-in direction—frontal section of the circumferential wall area of the plug component housing overlaps the matching plug component on the outside, wherein the locking element projects radially towards the inside beyond an inner surface of the circumferential wall area, the locking of the locking element with the matching locking element is achieved by moving the locking element transversely to the plug-in direction of the plug connector along the circumferential wall area, and the unlocking of the moveable locking element from the fixed locking element is accomplished by moving the locking element via the actuation element of the sliding sleeve transversely to the plug-in direction of the plug connector along the circumferential wall area, where the locking element moves when unlocking in opposite direction as while locking, wherein the locking element and the matching locking element comprise associated connection slide surfaces that move the locking element against the locking direction when the plug component is plugged into the matching plug component, and wherein the locking element of the plug component and the actuation element of the sliding sleeve have associated unlocking slide surfaces that are inclined towards the plug-in direction of the plug component relative to the face side of the plug component and which move the locking element against the locking direction into the release position when the sliding sleeve of the plug component is displaced axially against the plug-in direction of the plug component.

* * * * *